US006634146B2

(12) United States Patent
Carlson

(10) Patent No.: US 6,634,146 B2
(45) Date of Patent: Oct. 21, 2003

(54) INSTALLATION POSITIONING SYSTEM AND METHOD

(76) Inventor: Martin G. Carlson, P.O. Box 2706, Baxter, MN (US) 56425

( * ) Notice: Subject to any disclaimer, the term of this patent is extended or adjusted under 35 U.S.C. 154(b) by 137 days.

(21) Appl. No.: 09/776,064

(22) Filed: Feb. 2, 2001

(65) Prior Publication Data

US 2002/0104277 A1 Aug. 8, 2002

(51) Int. Cl.[7] ..... E06B 3/00

(52) U.S. Cl. ..... 52/204.55; 52/213; 52/208; 52/214; 52/204.55; 52/202

(58) Field of Search ..... 52/213, 208, 214, 52/204.55, 202

(56) References Cited

U.S. PATENT DOCUMENTS

| | | | | |
|---|---|---|---|---|
| 2,936,980 A | | 5/1960 | Rapata | |
| 3,102,311 A | | 9/1963 | Martin et al. | |
| 3,186,047 A | | 6/1965 | Schwester et al. | |
| 3,368,247 A | | 2/1968 | Orban | |
| 3,486,201 A | | 12/1969 | Bourne | |
| 3,802,690 A | | 4/1974 | Tavano | |
| 3,836,118 A | | 9/1974 | Meyer | |
| 3,953,015 A | | 4/1976 | Taylor et al. | |
| 4,237,614 A | | 12/1980 | Williams | |
| 4,821,472 A | | 4/1989 | Tix | |
| 5,370,377 A | | 12/1994 | Van Der Meer | |
| 5,966,878 A | | 10/1999 | Freund | |
| 6,192,640 B1 | * | 2/2001 | Snyder | 220/3.5 |
| 6,378,931 B1 | * | 4/2002 | Kolluri et al. | 296/146.15 |

* cited by examiner

*Primary Examiner*—Carl D. Friedman
*Assistant Examiner*—Steve M Varner
(74) *Attorney, Agent, or Firm*—Fredrikson & Byron, P.A.

(57) ABSTRACT

A system and method for installing a construction component, such as a window unit, in proper position within a construction component opening, such as a framed opening, of a structure or building. The system employs a position securing means attached to the periphery of the construction component. The position securing means may be a strap of flexible, semi-rigid, or rigid material or combination thereof, or a self-locking device. The position securing means is adapted for attachment to a construction component opening when the construction component is in proper position. In the method of the invention, a construction component carrying a position securing means is placed in proper position within a construction component opening. Once in proper position, the position securing means is attached to the construction component opening, securing the component in proper position. The system and method of the invention may be utilized for installation of most generally planar construction components and, more specifically, may be utilized for installation of window units in proper position within a framed opening.

49 Claims, 5 Drawing Sheets

INSTALLATION POSITIONING SYSTEM AND METHOD

BACKGROUND OF THE INVENTION

1. Field of the Invention

The invention relates to a system and method for installing a construction component, such as a window unit, in proper position within a construction component opening, such as a framed opening.

2. Description of the Prior Art

During the course of construction of buildings, homes, and other structure, various construction components need to be installed within generally vertical or horizontal construction component openings, i.e., recesses of building frame, walls, ceilings or the like. Construction components, such as ceiling lights, and window units (both interior and exterior), require relatively accurate positioning within a construction component opening in which the construction component will be permanently housed and installed.

Typically, placing the construction component in proper position within a construction component opening is a time consuming task that ordinarily requires a series of adjustments and shimming by the workers. This can best be illustrated by discussion of the problem where the construction component is a window unit and the construction component opening is a framed opening of a structure, such as a house, that is to receive the window unit.

Framed window openings are usually about a half inch to an inch larger than the window unit to be installed therein. This provides approximately a half inch space or less between the outer edges of the window unit and the interior of the framed opening. Once the window unit is initially positioned in the framed opening, carpenters would urge the window into approximate proper position and then need to shim the window through a series of adjustments in order to place the window unit in proper position. This process can take from up to 45 minutes per window and usually requires at least two persons to perform the task. One person is on the inside of the structure and the other on the exterior. They would, through observation and communication back and forth, make various adjustments in the positioning of the window unit before securing it in place.

Sometimes in the process of securing the window unit in place, one side may be shifted out of proper position. In addition, incidental contact from workers, equipment, or construction material, or other forces, such as wind, may cause the window unit to shift out of position. If any of these things happen, readjustments are required to place the window unit back into proper position.

The thus described process can be tedious and because of the time required to properly install a window unit, workers, depending on schedule, may forego the careful adjustments steps necessary to place the window unit in proper position. The result is that the window unit may tip somewhat inwardly or outwardly, or from one side or the other, or otherwise may be spaced, in a direction normal to the window, from the proper position with respect to the framed opening. If that happens, proper finishing of the interior wall surface and application of trim material to and around the window requires an inordinate amount of time. Carpenters may then cover up the lack of proper positioning by various means, leaving the window unit askew. Further, the trim may be left with a gap or tipped to meet the improperly placed window. This provides a second-rate finished product which is not desirable.

To avoid the time delays and associated costs that might cause a worker to cut corners, resulting in a finished product of diminished quality, it would be desirable to provide a system that allows for installation of a construction component, such as a window unit, in proper position within a construction component opening, such as a framed opening, of a structure.

SUMMARY OF THE INVENTION

In one embodiment of the invention, the installation positioning system comprises a generally planar construction component having a periphery and at least one position securing means attached to the periphery of the construction component. The position securing means extends generally normal to the plane of the construction component and, when positioned for installation in a construction component opening, extends inwardly of the construction component opening. The position securing means, in a preferred embodiment, can be a strap.

In another embodiment, the invention is a window installation positioning system comprising a window unit with at least one position securing means attached thereto. The position securing means has an attachment end adapted for attachment to a framed opening and extends inwardly of the framed opening when the window unit is positioned for installation therein.

In either embodiment of the invention, the position securing means can be a strap. For example, in a preferred embodiment, the position securing means is a strap attached to the window unit. The strap may have an attachment end adapted for attachment to a framed opening and the strap extends inwardly towards the framed opening when the window unit is positioned for installation therein. Further, the strap, when attached to the framed opening, secures and maintains the window unit in proper position.

Whether the system is for proper installation of a construction component or, specifically, a window unit, the strap or position securing means can be flexible, semi-rigid, rigid or combination thereof. The strap can be attached to a construction component, such as a window unit, and to a construction component opening, such as a framed opening by various means, chemical, mechanical, adhesive, or heat welding. Further, in a preferred embodiment of the system of the invention, the position securing means can be a self-locking device such as a strap attached to a construction component, such as a window unit, and a locking unit. The locking unit has a mounting portion for attachment to the construction component and a locking portion for receiving and one-way engagement of the strap. The system may be provided with the strap partially inserted into and engaged by the locking portion of the locking unit.

In another embodiment, the invention is directed to a method for installing a construction component in proper position in a construction component opening of a structure. The method comprises the steps of: (a) providing a structure having a construction component opening; (b) providing a generally planar construction component having a periphery with at least one position securing means attached thereto, the position securing means having an attachment end adapted for attachment to the construction component opening and extending generally normal to the plane of the construction component and inwardly towards the construction component opening when the construction component is positioned for installation in the construction component opening; (c) placing the construction component in the construction component opening in proper position; and (d)

attaching the at least one position securing means to the construction component opening thereby securing the construction component in proper position.

In another embodiment, the invention is directed to a method for installing a window unit in proper position in a framed opening of a structure. The method comprises the steps of: (a) providing a structure having a framed opening; (b) providing a window unit having at least one position securing means attached thereto, the position securing means having an attachment end adapted for attachment to the framed opening and extending inwardly towards the framed opening when the window unit is positioned for installation in the framed opening; (c) placing the window unit in the framed opening in proper position; and (d) attaching the attachment end of the at least one position securing means to the framed opening thereby securing the window unit in proper position. In a preferred embodiment of the method of the invention, there are at least four position securing means attached to the window unit.

In each of the foregoing embodiments of the methods according the invention, the position securing means may be a strap. The strap can be flexible, semi-rigid, rigid, or combination thereof and can be attached to a construction component opening, such as a framed opening, and to a construction component, such as a window unit, by various means, chemical, mechanical, adhesive, or heat welding. The position securing means may also be a self-locking device such as a strap, attached to a window unit or other construction component, and a locking unit. The locking unit has a mounting portion for attachment to a framed opening or other construction component opening and a locking portion for receiving and one-way engagement of the strap.

DETAILED DESCRIPTION OF THE INVENTION

Figure 1:
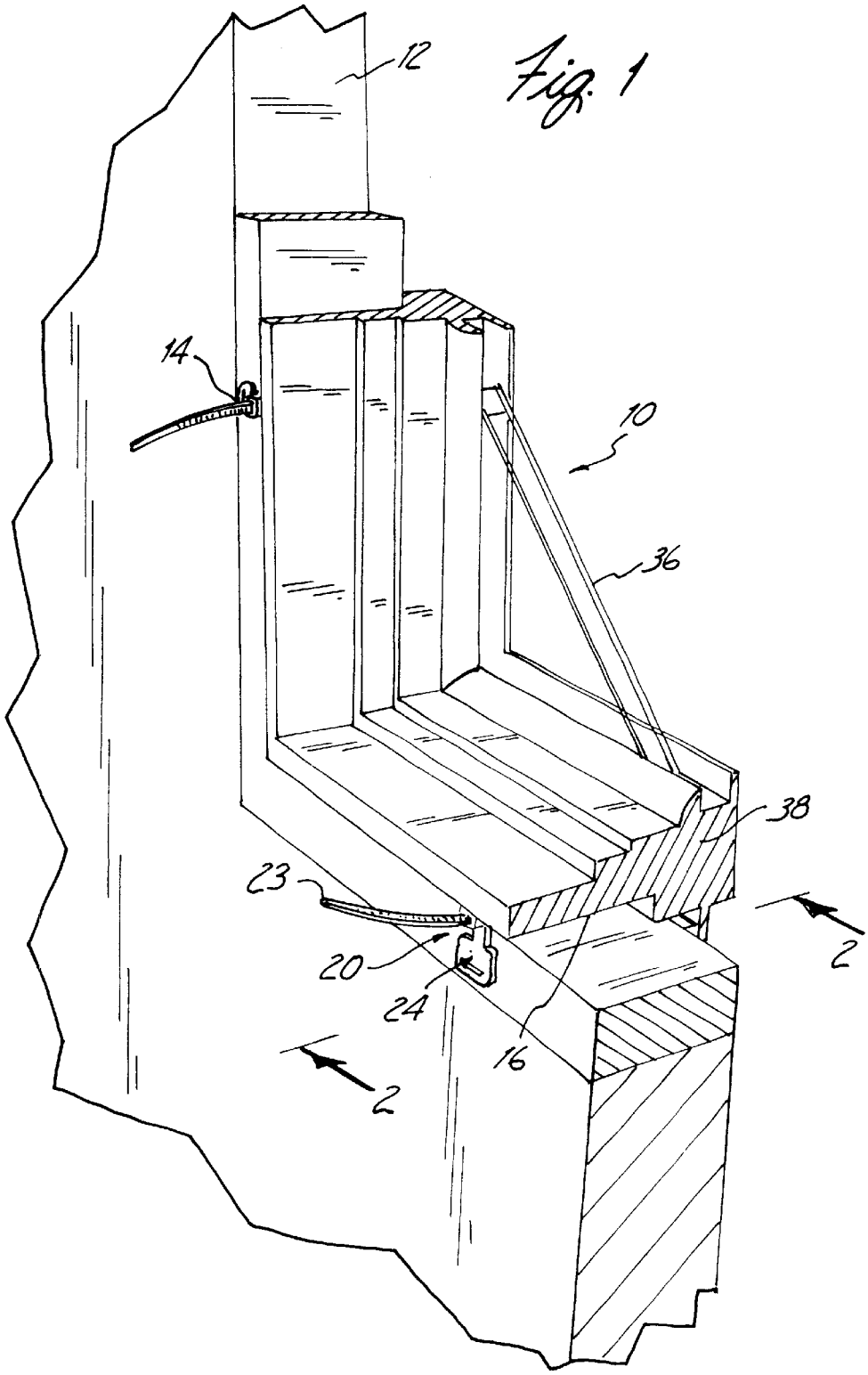
FIG. 1 is a broken-away, perspective cross-sectional view of an installation positioning system according to the invention.

The system of the invention may be utilized with a variety of construction components 10 that require proper positioning in a construction component opening 12. The system may also be utilized to secure and maintain a construction component 10 in a desired position while allowing workers to complete installation or construction of associated components or trim work without shifting the construction component 10 out of the desired position. Where an additional worker previously may have been required to physically hold a construction component 10 in place while finishing or related additional work steps were being done by another worker, the system of the invention would eliminate the need for a worker to continue to physically hold a construction component 10 while such additional work steps are completed. Further, use of the system would help avoid any inadvertent shifting of the construction component from its desired position.

The system of the invention can be utilized with a variety of generally planar construction components 10 to be installed in recesses or construction component openings 12 of a building, home or other structure under construction. The system of the invention utilizes a position securing means 14 attached to the periphery 16 of a construction component 10, such as a window. The positioning securing means 14 can be attached to the construction component 10 by any known means, including but not limited to chemical or adhesive bond, mechanical means or heat-welding. Preferred mechanical means include those generally known to those skilled in the art and include but are not limited to nails, screws, staples, clamps, insertion into a groove or kerf, and the like.

Regardless of how the position securing means 14 is attached to the periphery 16 of the construction component 10, the position securing means 14 will extend generally normal to the plane or periphery 16 of the construction component 10 and inwardly toward the construction component opening 12 when the construction component 10 is positioned within the opening 12 for installation. Further, the position securing means may extend inwardly beyond the innermost face or edge of the construction component or its periphery.

Figure 4:
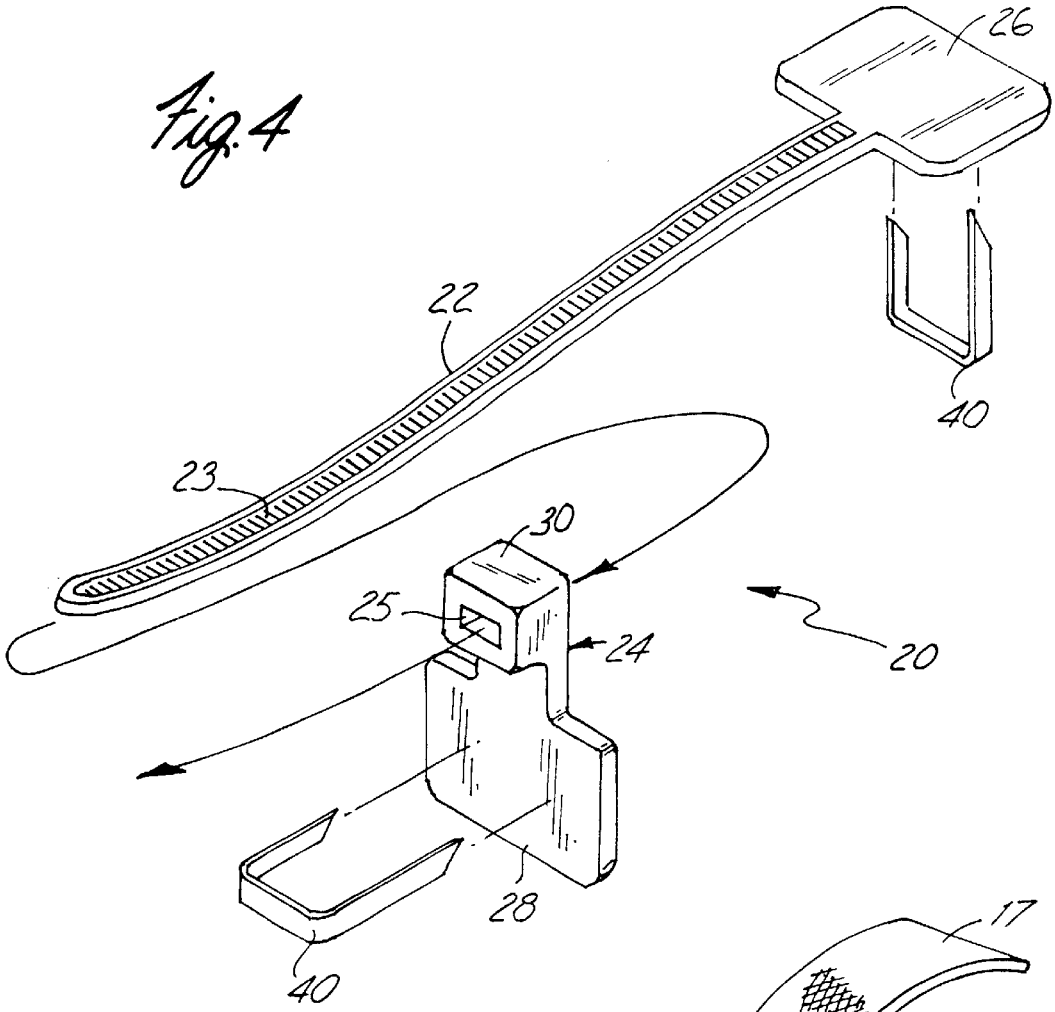
FIG. 4 is an exploded view of a position securing means according to the invention.
Figure 5:
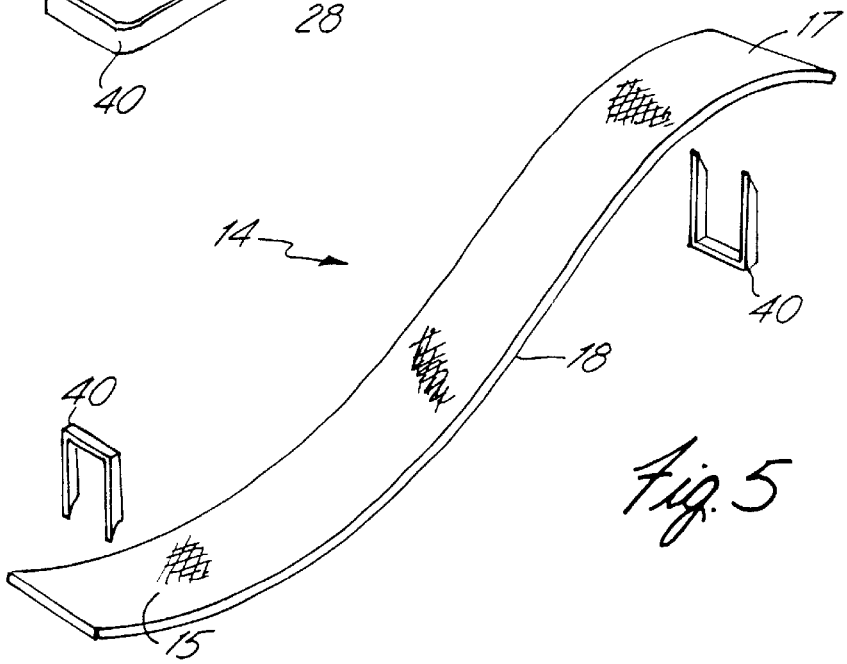
FIG. 5 is an exploded view of a modified position securing means according to the invention.
Figure 6:
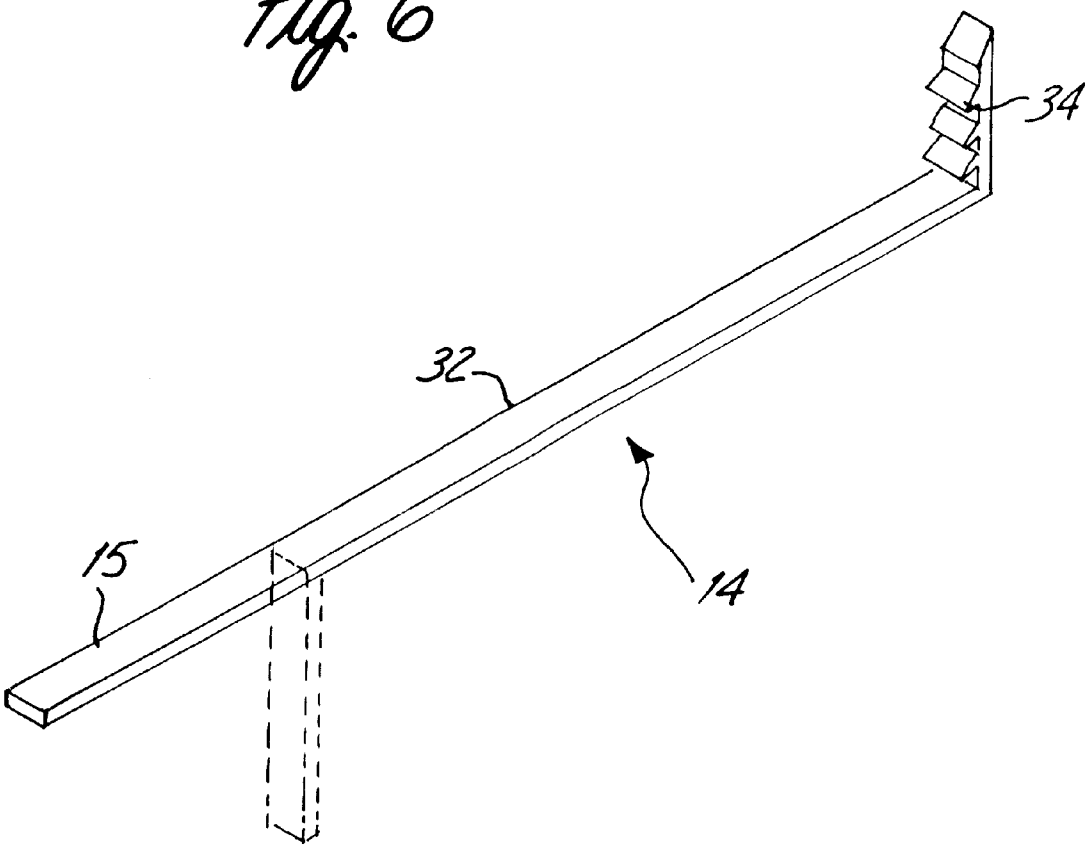
FIG. 6 is an exploded view of yet another position securing means according to the invention.

The position securing means 14, typified in FIGS. 4, 5 and 6 as a strap, is adapted for attachment to the construction component opening. As with attachment of the positioning securing means 14 to a construction component 10, attachment end 15 of the position securing means 14 may be attached to the construction component opening 12 by any known means, including but not limited to chemical or adhesive bonds, mechanical means, such as those referenced above, or heat-welding.

The position securing means 14 may comprise a simple strap 18 or band of material, e.g.; of plastic, metal or even fabric, such as can be seen in FIG. 5. The strap 18 has attachment ends 15 and 17. A strap 18 can be seen in FIG. 3 attached, by staple 40 through attachment end 17, to the periphery 16 of a window unit 10 and to a framed opening 12 with a staple 40 through attachment end 15.

The position securing means may comprise a self-locking device 20 as can be seen in FIG. 4. With reference to FIG. 4, the self-locking device 20 includes a strap 22 and a locking unit 24. The strap 22 has an attachment end 26 by which the strap 22 can be attached to a construction component 10 by, for example, a staple 40 and an locking or insertion end 23. The locking unit 24 has a mounting portion 28 and a locking portion 30. Insertion end 23 of strap 22 can be inserted into the locking portion 30 and the locking portion 30 is adapted to receive the strap 22 in one-way engagement. The locking portion 30 has an opening or slot 25 to receive insertion end 23 of the strap 22. Within the slot is a pawl or small flexible tooth (not shown) that engages the strap 22. The surface of the strap 22 may be textured with transverse ribs (shown in FIG. 4) or other protuberances that can be engaged by the tooth or pawl within the slot 25 of the locking portion 30. The strap 22 may, instead, have a series of perforations forming holes that can be engaged by the tooth or pawl within the slot 25. Thus, when the insertion end 23 of the strap 22 is inserted into slot 25, the pawl or tooth engages the strap, allowing the strap 22 to move in one direction but prevents the strap 22 from movement in the opposite direction. Locking means of this type are commonly used to bundle pipe and wires.

With reference to FIG. 6, the position securing means 14 may also be a strap 32 with a modified end 34 adopted for attachment to a construction component. The modified end can be inserted into a groove or kerf formed in the periphery of a construction component, such as the frame of a window unit. The strap 32 also has an attachment end 15 for attachment to a construction component opening. The framed opening may also have a groove or kerf formed therein. In which case, one or both ends of a strap may be modified and adapted for insertion into the groove in a construction component, a construction component opening or both.

Whether the position securing means 14 is a simple strap 18, a self-locking device 20, or modified strap 32, the position securing means 14 can be made of flexible, semi-rigid, or rigid materials or combinations thereof. It can be made of a variety or combination of materials including but not limited to plastics, polymeric materials, metals, or even fabrics. The type of materials suitable for use as the position securing means 14 will depend upon the construction component 10 and the location of the construction component opening 12 in a building or other structure.

For instance, if the construction component 10 is to be placed in a generally horizontal recess or construction component opening 12, e.g., a ceiling, the position securing means will be, at least momentarily, load bearing if installed from below. For installation of a construction component 10 in a horizontal construction component opening 12, the position securing means 14 would have to be of a material of sufficient strength to bear the load of the construction component 10. The required strength of the position securing means 14 will depend upon the number of position securing means 14 attached to the construction component.

Generally, the strength of the position securing means 14 is not of concern for construction components 10 that are to be installed in a vertical construction component opening 12, such as an interior or exterior wall. In such an application of the system of the invention, the position securing means will not need to be load bearing in order to secure and maintain the construction component 10 in proper position.

Whether the construction component opening 12 is vertical or horizontal, the construction components 10 that can be installed with the system and method of the invention will have a periphery 16, generally defined by an outer edge of the construction component. The position securing means will be attached to the periphery so that the strap extends generally normal to the plane of the construction component and inwardly toward the construction component opening when the construction component is placed therein for installation. The outer edge or periphery 16 will abut, be next to and bordered by, the construction component opening 12 when the construction component 10 is positioned for installation.

The system of the invention may be understood with reference to FIGS. 1–6, utilizing a window unit 10 as the construction component 10 and a framed opening 12 as the construction component opening 12. FIG. 1 depicts in broken-away, perspective, cross-sectional view a window unit 10 positioned within a framed opening 12. A window unit is generally made up of at least a single pane of glass enclosed within a frame. In FIG. 1, the window unit 10 has two panes of glass 36 enclosed within a frame 38. The frame 38, typically, may be made of wood with an outer protective layer of plastic or metal. The frame 38 may also be made out of metal or polymeric material. The frame 38 may typically come with a flange projecting away from the window frame. Such flanges are utilized for attachment to the surrounding support structure of a framed opening. The details of the construction of a window unit are not critical to the understanding of the invention and, therefore, are not included herein. However, the periphery 16 of the window unit 10 is defined by the outer edge of the window frame 38 and abuts, is next to and bordered by, the framed opening 12 when the window unit is positioned for installation.

As can be seen, in FIG. 1, the position securing means comprises a self-locking device 20, as shown in FIG. 4. The strap 22 of self-locking device 20 extends inwardly toward the framed opening and through the slot 25 of the locking portion 30 of locking until 24. The strap 22 is attached to the periphery of the window unit; but in the installed position, the attachment cannot be seen. The strap 22 can be seen to extend inwardly beyond the innermost face or edge of the window unit or its frame 38.

Figure 2:
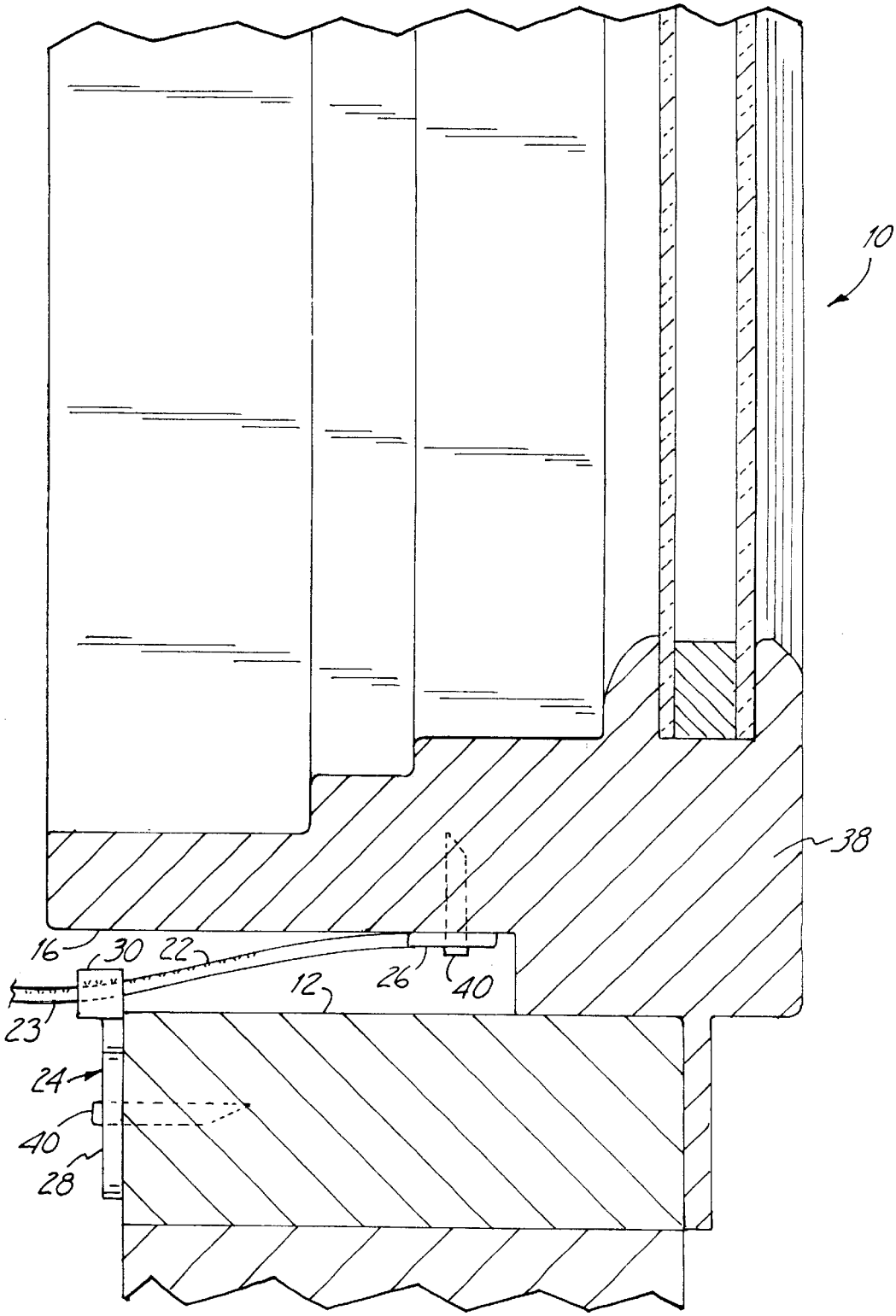
FIG. 2 is a broken-away, cross-sectional view taken along line 2—2 of FIG. 1.
Figure 3:
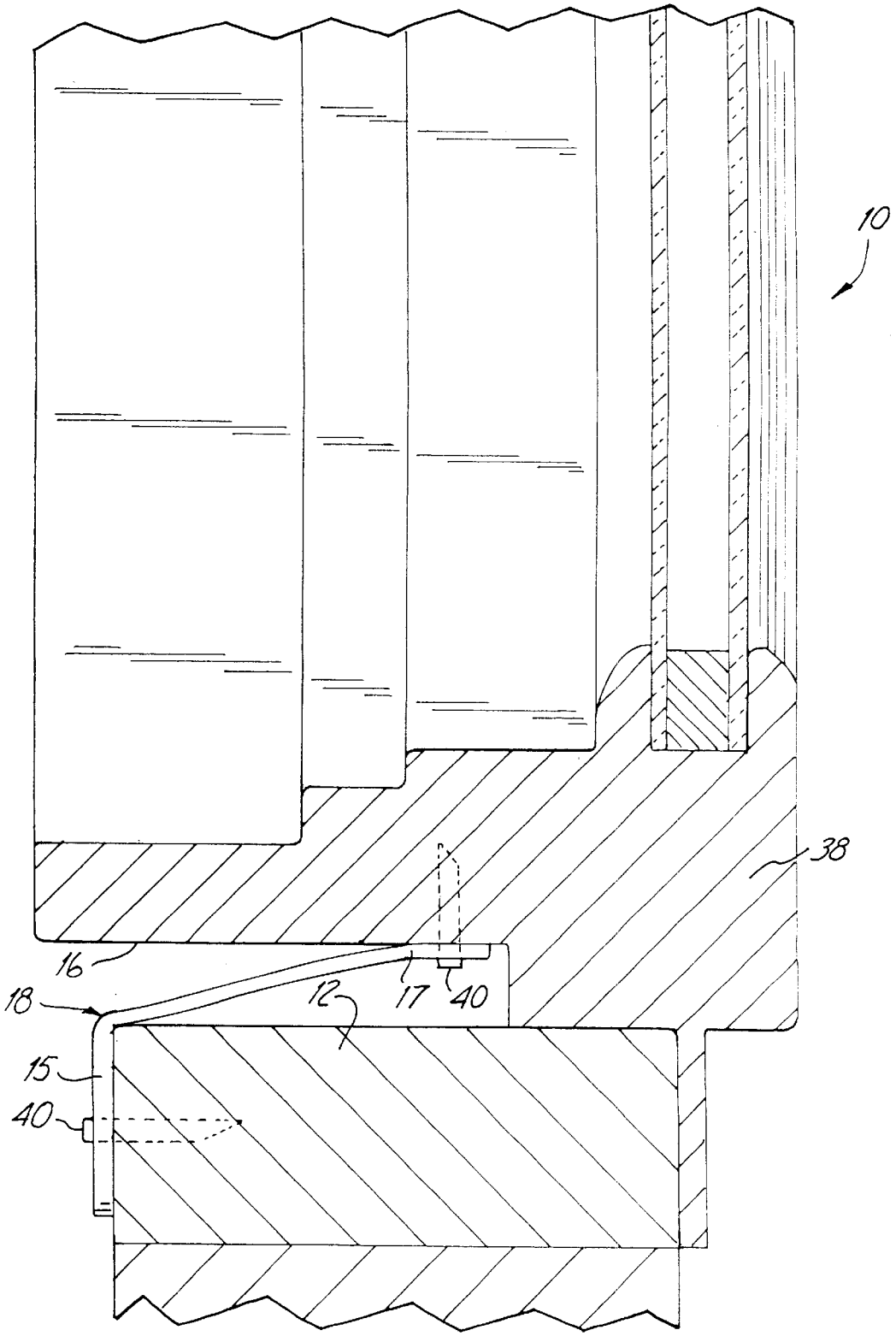
FIG. 3 is a broken-away, cross-sectional view similar to that of FIG. 2, showing another embodiment of a system according to the invention.

In FIGS. 2 and 3, the position securing means can be seen attached to the periphery 16 of the window unit 10 and to the framed opening 12. In FIG. 3, the position securing means is a strap 18 as shown in FIG. 5. The strap is attached to the periphery 16 of the window unit 10 and to the framed opening 12 by staples 40. In FIG. 2, the position securing means is a self-locking device 20 as shown in FIG. 4. The strap 22 of the self-locking device 20 is attached to the periphery 16 of the window unit with a staple 40, through the attachment end 26. Insertion end 23 of the strap 22 can be seen to be inserted through the locking portion 30 of the locking unit 24; and the locking unit 24 is attached to the framed opening with a staple 40 through the mounting portion 28. It can readily be seen that the position securing means in FIGS. 2 and 3 could be attached to the window unit 10 and framed opening 12 by other means such as those referred to above, including insertion of the modified end or ends of a strap within a kerf. The means of attachment will depend upon the types of materials making up the position securing means, the periphery of the window unit 10 and the framed opening 12.

The use of position securing means 14 in the system of the invention can allow skilled workers to reduce the time necessary to properly position and install a construction component 10 in a construction component opening 12. Once a construction component 10 is installed and secured in proper position, skilled workers can complete other construction and finish work around the construction component 10 with reasonable assurance that the construction component 10 will be maintained in proper position to provide a quality finished product.

In accordance with a method of the invention, a structure having a construction component opening 12 is provided. Also provided is a generally planar construction component 10 having a periphery with at least one position securing means attached thereto. The position securing means 14 has an attachment end adapted for attachment to the construction component opening 12 and extends generally normal to the plane of the construction component and inwardly towards the construction component opening 12 when the construction component 10 is positioned for installation in the construction component opening 12. The construction component 10 with position securing means attached thereto is placed in the construction component opening 12 in proper position. Once in proper position, the attachment end of the at least one position securing means is attached to the construction component opening 12 thereby securing the construction component 10 in proper position.

In accordance with a preferred method of the invention involving the installation of windows, a structure having a framed opening and a window unit 10 having at least one, and preferably four, position securing means attached to the periphery of the window unit are provided. Whether the positions securing means is strap or a self-locking device, the straps of the position securing means each have an attachment end adapted for attachment to a framed opening; and they each extend inwardly towards the framed opening 12 when the window unit 10 is positioned for installation in the framed opening 12.

Placing the window unit 10 within the framed opening 12 may be accomplished using standard construction techniques, such as workers lifting the window unit into the framed opening or by mechanical hoist for installation in an upper level of an building or other structure. Typically, placing the window unit 10 in proper position requires at least two workers, one inside and one outside. The workers communicate back and forth about the positioning of window unit 10. Once in the framed opening 12, the window unit 10 is placed in proper position through a series of adjustments.

When the worker on the inside observes that the window unit is in proper position, the inwardly extending position securing means 14, such as straps 18 or 32, can be attached to the framed opening 12. If the position securing means is a strap 18 or 32, the attachment end 15 of each position securing means 14 is attached to the framed opening 12 thereby securing the window unit 10 in proper position. If the position securing means 14 is a self-locking device 20, the strap 22 is inserted through the slot 25 of the locking portion 30 and the locking unit 24 is attached to the framed opening 12. Of course, the locking unit 24 could be attached to the framed opening prior to insertion of the strap 22 through the slot 25, but insertion prior to attachment is preferable. Once the locking unit is attached to the framed opening, the strap 22 can be drawn through the slot 25 thereby securing the window unit 10 in proper position. The methods of attaching the straps or locking unit 24 to the framed opening 12 have been previously discussed above.

FIGS. 1–3, each show window unit 10 secured to the framed opening 12 according to methods of the invention utilizing different embodiments of the system of the invention. And, in each figure, the innermost surface of the window frame 38 projects beyond, or inside of, the framed opening 12. This is to accommodate the application of inner wall surface materials.

The number of position securing means 14, e.g. straps, needed to secure a window unit 10 in place within a framed opening 12 can vary and will depend upon the size, and possibly the shape, of the window unit 10. As with the previous embodiment of the invention, if the window unit 10 is to be installed in other than a standard, vertically positioned framed opening 12, the number of position securing means 14 or straps will also depend upon the strength of the position securing means 14 or straps because they will be load-bearing.

While exemplary embodiments of the system invention and methods of the invention have been illustrated and described, it should be understood that various adaptations and modifications may be made therein without departing from the spirit of the invention and the scope of the appended claims.

What is claimed:

1. An installation positioning system comprising:

a. a generally planar construction component for installation in proper position into a construction component opening, the construction component having a perimeter edge; and b. at least one position securing means attached to the perimeter edge of the construction component, the position securing means:

(i) extending generally normal to the plane of the construction component and inwardly toward the construction component opening when the construction component is positioned for installation in the construction component opening; and (ii) having an attachment end adapted for attachment to the construction component opening.

2. The system of claim 1 wherein the position securing means is a strap.

3. The system of claim 2 wherein the strap is flexible.

4. The system of claim 2 wherein the strap is semi-rigid.

5. The system of claim 2 wherein the strap is rigid.

6. The system of claim 1 wherein the position securing means is a self-locking device.

7. The system of claim 6 wherein the self-locking device comprises:

a. a strap attached to the construction component; and b. a locking unit, the locking unit having a mounting portion for attachment to the construction component and a locking portion for receiving and one-way engagement of the strap.

8. The system of claim 7 wherein the strap is partially inserted into and engaged by the locking portion of the locking unit.

9. The system of claim 1 wherein the means of attaching the position securing means to the construction component is selected from any one of the following: mechanical attachment, chemical attachment, adhesive attachment or heat welding.

10. The system of claim 1 wherein the means of attaching the position securing means to the construction component opening is selected from any one of the following: mechanical attachment, chemical attachment, adhesive attachment or heat welding.

11. The system of claim 1 wherein the construction component is a window unit and the construction component opening is a framed opening.

12. A window installation positioning system comprising:

a. a window unit having a perimeter edge; and b. a least one position securing means attached to the perimeter edge of the window unit, wherein the position securing means:

(i) has an attachment end adapted for attachment to a framed opening; and (ii) extends inwardly toward the framed opening when the window unit is positioned for installation in the framed opening.

13. The system of claim 12 wherein the position securing means is a strap.

14. The system of claim 13 wherein the strap is flexible.

15. The system of claim 13 wherein the strap is semi-rigid.

16. The system of claim 13 wherein the strap is rigid.

17. The system of claim 13 wherein the window unit has a frame with a groove therein and the strap has a modified end adapted for insertion into the groove, the modified end being inserted into the groove.

18. The system of claim 12 wherein the position securing means is a self-locking device.

19. The system of claim 18 wherein the self-locking device comprises:

a. a strap attached to the window unit;

b. a locking unit, the locking unit having a mounting portion for attachment to the framed opening and a locking portion for receiving and one-way engagement of the strap.

20. The system of claim 19 wherein the strap is partially inserted into and engaged by the locking portion of the locking unit.

21. The system of claim 20 wherein at least four self-locking devices are attached to the window unit.

22. The system of claim 12 wherein the means of attaching the position securing means to the window unit is selected from any one of the following: mechanical attachment, chemical attachment, adhesive attachment or heat welding.

23. The system of claim 12 wherein the means of attaching the position securing means to the framed opening is selected from any one of the following: mechanical attachment, chemical attachment, adhesive attachment or heat welding.

24. The window installation positioning system of claim 13 wherein at least four straps are attached to the window unit.

25. A window installation positioning system comprising:

a. a window unit having a perimeter edge; and b. a strap mechanically attached to the perimeter edge of the window unit, the strap having an attachment end adapted for attachment to a framed opening, wherein the strap when attached to the framed opening secures and maintains the window unit in proper position.

26. A window installation positioning system comprising:

a. a window unit having a perimeter edge; and b. a strap chemically attached to the perimeter edge of the window unit, the strap having an attachment end adapted for attachment to a framed opening, wherein the strap when attached to the framed opening secures and maintains the window unit in proper position.

27. A window installation positioning system comprising:

a. a window unit having a perimeter edge; and b. a strap attached to the perimeter edge of the window unit by heat welding, the strap having an attachment end adapted for attachment to a framed opening, wherein the strap when attached to the framed opening secures and maintains the window unit in proper position.

28. A window installation positioning system comprising:

a. a window unit having a perimeter edge; and b. a strap adhesively attached to the perimeter edge of the window unit, the strap having an attachment end adapted for attachment to a framed opening, wherein the strap when attached to the framed opening secures and maintains the window unit in proper position.

29. The system of any one of claims 25–28 wherein the strap is flexible.

30. The system of any one of claims 25–28 wherein the strap is semi-rigid.

31. The system of any one of claims 25–28 wherein the strap is rigid.

32. The system of any one of claims 25–28 wherein the means of attaching the position securing means to the framed opening is selected from any one of the following: mechanical attachment, chemical attachment, adhesive attachment or heat welding.

33. The system of any one of claims 25–28 wherein the system further comprises:

a. a locking unit, the locking unit having a mounting portion for attachment to the framed opening; and b. a locking portion for receiving and one-way engagement of the strap.

34. The system of claim 33 wherein the strap is partially inserted into and engaged by the locking portion of the locking unit.

35. A method for installing a construction component in proper position in a construction component opening of a structure comprising:

a. providing a structure having a construction component opening;

b. providing a generally planar construction component having a perimeter edge with at least one position securing means attached to the perimeter edge of the construction component, the position securing means:

(i) having an attachment end adapted for attachment to the construction component opening; and (ii) extending generally normal to the plane of the construction component and inwardly toward the construction component opening when the construction component is positioned for installation in the construction component opening;

c. placing the construction component in the construction component opening in proper position; and d. attaching the attachment end of the at least one position securing means to the construction component opening thereby securing the construction component in proper position.

36. A method for installing a window unit in proper position in framed opening of a structure comprising:

a. providing a structure having a framed opening;

b. providing a window unit having a perimeter edge and at least one position securing means attached to the perimeter edge of the window unit, the position securing means:

(i) having an attachment end adapted for attachment to the framed opening; and (ii) extending inwardly toward the framed opening when the window unit is positioned for installation in the framed opening;

c. placing the window unit in the framed opening in proper position; and d. attaching the attachment end of the at least one position securing means to the framed opening thereby securing the window unit in proper position.

37. A method for installing a window unit in proper position in framed opening of a structure comprising:

a. providing a structure having a framed opening;

b. providing a window unit having a perimeter edge and at least four position securing means attached to the perimeter edge of the window unit, the position securing means each:

(i) having an attachment end adapted for attachment to the framed opening; and (ii) extending inwardly toward the framed opening when the window unit is positioned for installation in the framed opening;

c. placing the window unit in the framed opening in proper position; and d. attaching the attachment end of at least four position securing means to the framed opening, thereby securing the window unit in proper position.

38. The method of any one of claims 35–37 wherein the position securing means is a strap.

39. The method of claims 38 wherein the strap is flexible.

40. The method of claim 38 wherein the strap is semi-rigid.

41. The method of claim 38 wherein the strap is -rigid.

42. The method of any one of claims 35–37 wherein the position securing means is a self-locking device.

43. The method of claim 42 wherein the self-locking device comprises:

a. a strap; and b. a locking unit, the locking unit having a mounting portion for attachment to the construction component and a locking portion for receiving and one-way engagement of the strap.

44. The method of claim 43 wherein the strap is partially inserted into and engaged by the locking portion of the locking unit.

45. The method of claim 42 wherein the construction component is a window unit and the construction component opening is a framed opening.

46. The method of claim 43 wherein the construction component is a window unit and the construction component opening is a framed opening.

47. The method of claim 35 wherein the means of attaching the position securing means to the construction component and to the construction component opening is selected from any one of the following: mechanical attachment, chemical attachment, adhesive attachment or heat welding.

48. The method of claim 47 wherein the construction component is a window unit and the construction component opening is a framed opening.

49. The method of claim 35 wherein the position securing means is a strap having a modified end adapted for insertion into a groove formed in the construction component, the modified end being inserted into the groove.

* * * * *